United States Patent [19]

Padovani

[11] Patent Number: 4,617,748

[45] Date of Patent: Oct. 21, 1986

[54] LABEL FOR EGG TRAYS AND THE LIKE

[75] Inventor: Pietro Padovani, Verona, Italy

[73] Assignee: I.S.A.P. Spa (Industrie Specializzate Articoli Plastici), Parona, Italy

[21] Appl. No.: 707,023

[22] Filed: Feb. 28, 1985

[30] Foreign Application Priority Data

Mar. 1, 1984 [IT] Italy ..... 84915 A/84

[51] Int. Cl.[4] ..... G09F 3/00

[52] U.S. Cl. ..... 40/312; 40/10 R; 229/915; 206/459; 206/546

[58] Field of Search ..... 40/10 R, 310, 312, 584, 40/124.1, 10; 206/546; 229/429

[56] References Cited

U.S. PATENT DOCUMENTS 1,828,680 10/1931 Rado ..... 40/312
2,285,212 6/1942 La May ..... 40/312
2,376,916 5/1935 Harden ..... 40/312
4,389,802 6/1983 McLaren ..... 40/307
4,472,896 9/1984 Brauner ..... 40/312

*Primary Examiner*—Gene Mancene
*Assistant Examiner*—Wenceslao J. Contreras

[57] ABSTRACT

A label for trays or containers for eggs or the like made of cardboard or similar material which has a substantially rectangular central body (23) with rounded corners is provided with at least one extension (27) which can be folded along at least one of the sides of its central body, is provided with radially intersecting cuts (25) forming tabs (24, 24') and/or holes (24''), which may also only be premarked, and can be glued to the lid of a container to form air cushions (37, 37') which protect the products which are subsequently held in the container and permit empty and open containers to be stacked.

16 Claims, 12 Drawing Figures

LABEL FOR EGG TRAYS AND THE LIKE

The label which is the object of the invention can be applied to egg trays, containers and the like made from sheets of thermoplastics material and consisting of two portions joined by a rib along which the lid portion can be bent back in order to be secured, by means of pressure fastenings, to the container portion which is provided with recesses to hold products.

The lid portion of the said trays or containers, for six eggs for example, is provided with two frusto-conical or truncated pyramidal spacers projecting inwardly from the top of the lid in order to prevent bowing of the said lid when the containers holding the eggs are stacked on top of each other. The lid portion is also provided with recesses of an annular or a spherical cap shape corresonding to the tops of the products held in the containers for purposes well known to those skilled in the art.

When the containers are stacked in an open position in order to be fed mechanically to packing machines, the said spacers nest together. For this reason these types of container are currently labelled when they are in the closed position after packing using labelling machines which apply a label to a surface corresponding substantially to the top of the lid, with a considerable hazard of breaking fragile products.

When a label is glued to the top of the lid, the said recesses of an annular or spherical cap shape form air cushions with the label which protect the products which will be subsequently held in the container.

The labelling machine for filled and closed containers which has hitherto been used for containers of the type referred to above is unsatisfactory in a number of respects.

It gives rise to a considerable loss of time with a consequent increase in packing costs.

The information placed on the label cannot be seen when the containers are stacked on display shelves.

In addition to this, the labelling of a closed container filled with eggs is unable to form protective cushions of air because the recesses in the lid which are already deformed by the tops of the eggs result in the formation of air cushions which are already squashed and do not satisfactorily perform the function of absorbing and therefore neutralising the effects of accidental impacts to those parts of the container with the result that the eggs break easily.

The object of the invention is to provide a label which can be applied to trays or containers of the type described which will:

- allow the containers to be stacked when empty and open,
- form protective cushions of air,
- advertise the product even when the containers are stacked on display shelves.

According to the present invention there is provided a label for trays or containers for eggs and the like which are made from sheets of synthetic thermoplastics material comprising two parts connected by a rib along which the lid portion with side walls can be folded back to be secured to the container portion by means of pressure fastenings, in which the top of the lid is provided with inwardly projecting hollow projections with conical sections and recesses, the said label which is made of cardboard or similar material and is glued to the lid has a central rectangular body with rounded corners characterised by the fact that it is provided with at least one substantially rectangular extension along at least one of the sides of the central body which is folded back to cover at least in part at least one of the side walls of the lid and means which are produced by throughcuts or are premarked corresponding to the bases of the projections enabling the open and empty containers to be stacked.

The advantages conferred by this invention are that the label which can be glued to empty and open containers permits the containers to be stacked, aids the formation of protective air cushions and allows the product to be advertised even when the containers are stacked on display shelves.

The invention will be further illustrated, by way of example, with reference to the accompanying drawings, in which.

Figure 2:
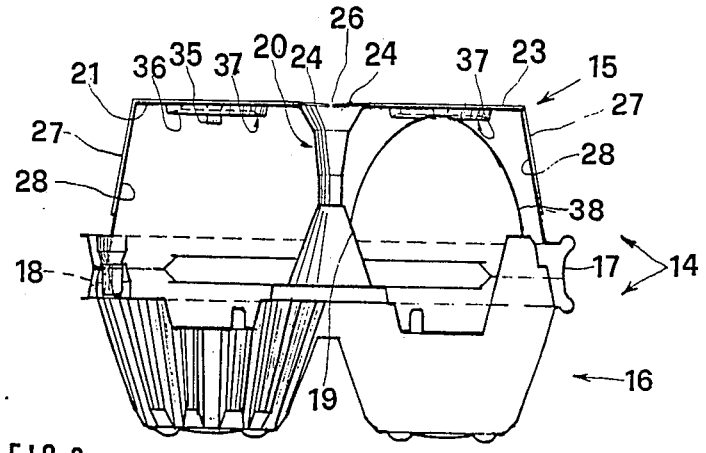
FIG. 2 is a diagrammatical vertical cross-section taken along the line 2—2 of FIG. 1.
Figure 1:
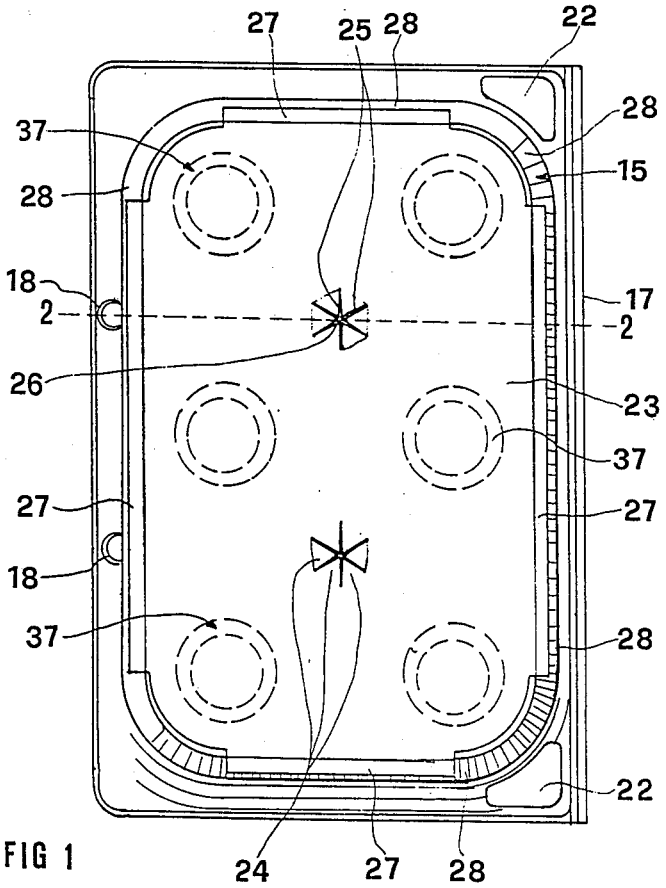
FIG. 1 is a view from above of a closed container with a label applied to the lid.

Bearing in mind that the figures are on different scales, it will be seen in FIGS. 1 and 2 that tray or container 14, which is designed to hold six eggs, comprises a lid 15, a lower body 16 having cavities to hold the eggs, and a rib 17 which permits the lid 15 to be bent back onto the body 16 guided by centering members 22 and to be secured by means of pressure fastenings 18.

In the space bounded by four recesses in body 16, there is a frusto-conical projection 19 against which rests projection 20 of the top 21 of lid 15 acting as a spacer between the top 21 and the body 16 of a closed container.

Figure 7:
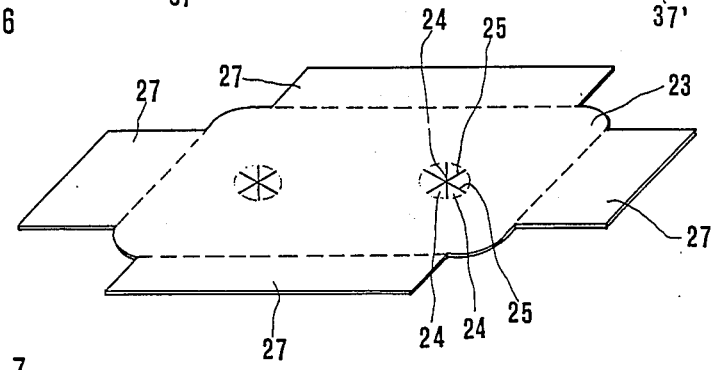
FIGS. 7, 8, 9 and 10 are diagrammatical perspective views of the four types of label according to the invention.

The central portion 23 of the label, as may be seen in detail in FIG. 7, has tabs 24 produced by cuts 25 which intersect radially at point 26 which lies on the axis of projection 20, and four folded extensions 27 which adhere to the side walls 28 of the lid 15.

The central portion 23 of the label and its extensions 27 are glued to the containers when these leave the machine in which they are thermoformed. They are then stacked in the open position in cardboard boxes to be dispatched to the said packing machines.

Figure 5:
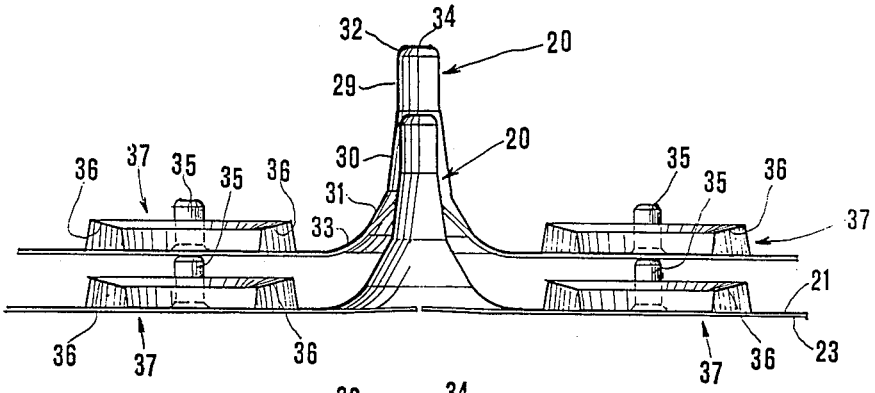
FIG. 5 is a view similar to the above after the container has been laid down.
Figure 4:
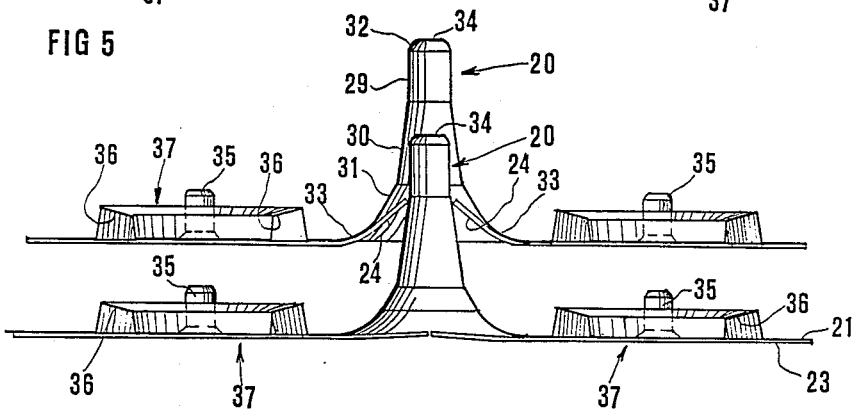
FIG. 4 is a view similar to the above as the container is being laid down.
Figure 3:
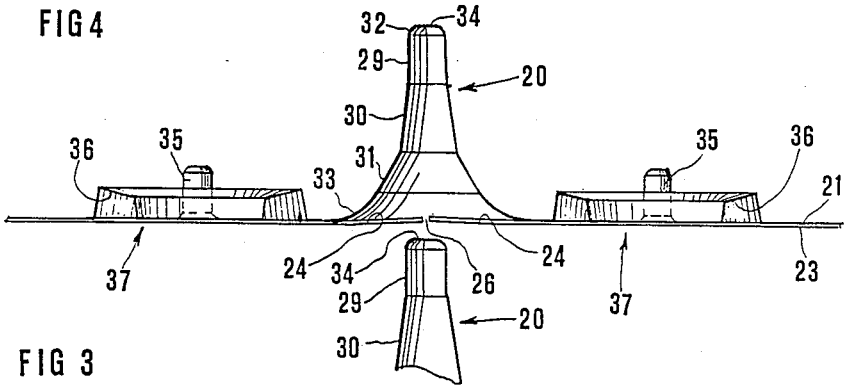
FIG. 3 is a partial and enlarged view of the section in FIG. 2 showing part of the lid of an empty and open container before it is placed on an underlying container of which only one of the spacers in the lid is shown.

As will be seen in FIGS. 3 to 5, hollow projections 20 consist of four frusto-conical sections 29, 30, 31, 32, of which section 32 is closed at the top, section 31 has a very accentuated conicity and has a flare 33 connecting with top 21 in the vicinity of its base.

This particular configuration of hollow projections 20, although advisable with respect to the invention, is not an essential feature.

As will be seen in the progression in FIGS. 3 to 5, tabs 24 become bowed upwards by projections 20.

When a container is first placed on an underlying container, see FIG. 4, tabs 24 come into contact with the tip 34 of underlying projection 20 and are opened upwards. This opening is accentuated the more projection 20 is inserted into projection 20 of the overlying container, although there is no folding of tabs 24 because of flare 33 and the high conicity of section 33, even when the projection is inserted to its maximum extent. As will be seen in FIG. 5, maximum insertion occurs when spacers 35 rest against top 21 and corresponding label 23 of the overlying container.

The lack of folding in tabs 24 has the result that, when the containers are unstacked for use in the packing machines, they return from the position in FIG. 5 to or almost to the position in FIG. 3. The said return of tabs 24 to their initial position may be aided, although not illustrated in the drawings, by grooves or reeding on the uppermost external portion of section 29.

As said above tabs 24 are produced by cuts which pass through the label, it is clear that such cuts can be marked in advance so that the tabs are only produced when the containers are stacked.

With reference to FIGS. 2 to 5, it will be seen that annular recesses 36 are made in the top 21 of the lid and these, together with label 23, form true air cushions 37 which yield elastically to protect the tops of eggs 38, which are subsequently placed in the container, from breakage.

Figure 6:
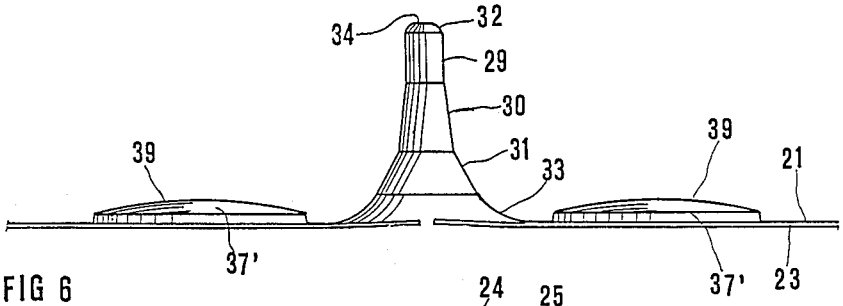
FIG. 6 is a view similar to that in FIG. 3 of an alternative embodiment of the container.

These recesses 36 may of course be replaced by spherical cap recesses 39, as shown in FIG. 6, without the effectiveness of the resulting air cushions being altered in any material way.

Figure 8:
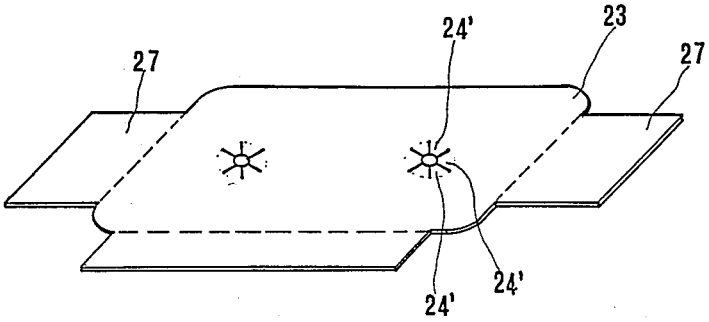

In the embodiment of FIG. 8, it will be noted that the central body 23 of the label has only three extensions 27 and that tabs 24 have points which are cut off by a circular punched hole made coaxially with the centre of intersection of the cuts made to produce the tabs.

Figure 9:
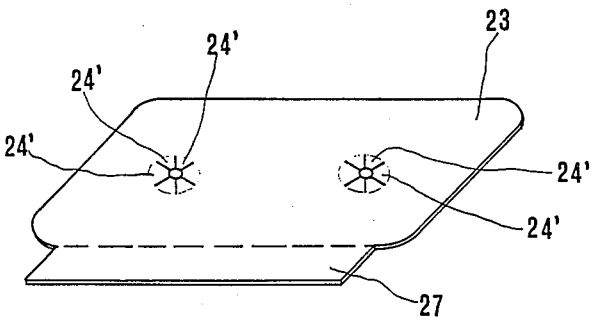

In the embodiment of FIG. 9, the label is substantially identical to that in FIG. 8 except that the number of extensions is reduced to only one, along one of the long sides of the label.

Figure 10:
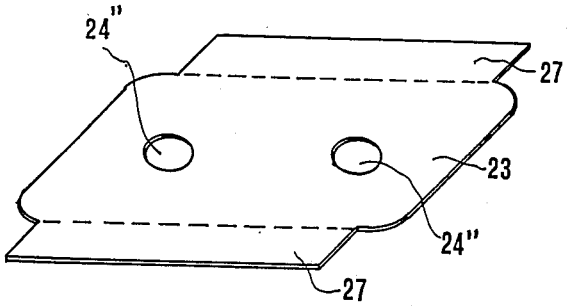

In the embodiment illustrated in FIG. 10, it will be seen that the central body 23 of the label has two extensions 27 along the longer sides and circular holes 24'' of a diameter slightly greater than that of hollow projections 20 viewed in relation to the base of sections 30.

It is also clear that circular holes 24'', even though they are not illustrated in the drawings, may be replaced by holes with any polygonal perimeter whatsoever without going beyond the scope of possible embodiments of the invention and, as in the case of tabs, they may be merely marked in advance.

Figure 12:
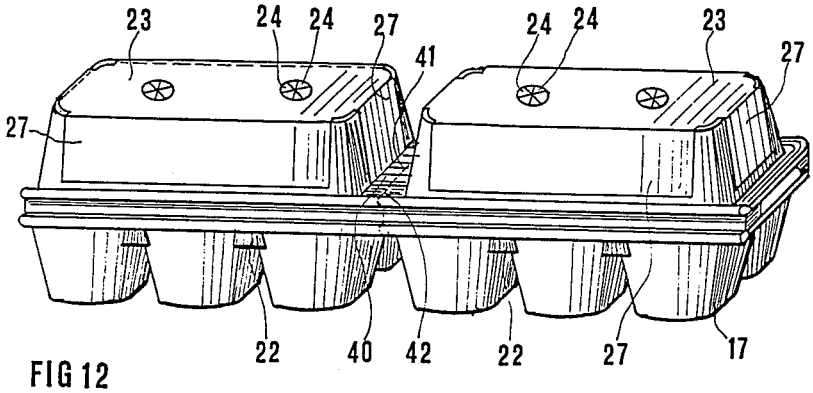
FIG. 12 is a perspective view of a container having a label of the type in FIG. 11.
Figure 11:
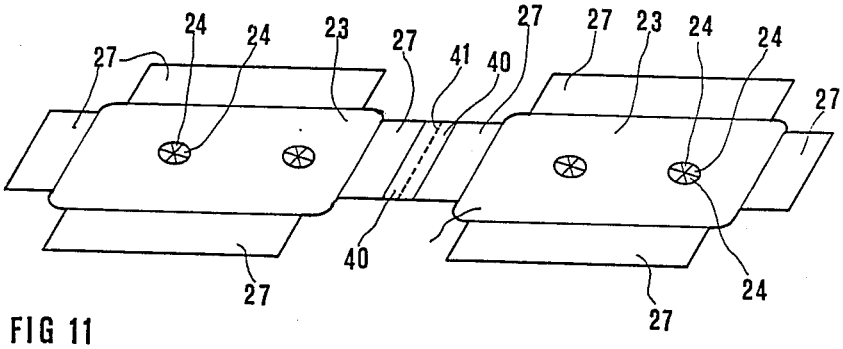
FIG. 11 is a diagrammatical perspective view of a label similar to that in FIG. 9 designed to be applied to double containers which can be separated along a predetermined break line.

In FIG. 11, there will be seen a label consisting of two labels identical to that in FIG. 7 held together by means of a connection 40 and provided with a predetermined break line 41 consisting of a series of perforations or cuts. This type of label can obviously be applied to containers for twelve eggs, as shown in FIG. 12, which can be separated into two parts along predetermined break line 42.

I claim:

1. In combination a container for eggs and the like and a label therefor, the container being made from sheets of synthetic thermoplastics material and comprising an upper portion having a top and sidewalls and a lower portion connected thereto by a rib along which the upper portion can be moved between an open and closed position and secured to the lower portion by means of pressure fastenings, in which the top of the upper portion is provided with inwardly projecting hollow projections with conical sections and recesses; the label being made of cardboard or the like and applied to the upper portion, the label comprising a central rectangular body with side edges and rounded corners, a substantially rectangular extension along at least one of the side edges of the central body which is folded to cover at least in part one of the side walls of the upper portion, and means produced by throughcuts corresponding to the projections enabling a plurality of open containers to be stacked.

2. The combination of claim 1, in which the means produced by throughcuts consist of tabs which are substantially triangular and produced by cuts which pass through the label and intersect radially at points which lie on the longitudinal axis of a projection.

3. The combination of claim 1, in which the means produced by throughcuts consists of tabs produced by cuts passing through the label which intersect at points lying on the longitudinal axis of a projection and have their points cut off by means of a circular hole punched coaxially with the center of intersection of the cuts.

4. The combination of claim 1, in which the means produced by throughcuts consist of circular holes whose centers each lie on the longitudinal axis of a projection and whose diameters are slightly greater than the widest diameter of the projections.

5. The combination of claim 1, characterized in that the label is attached to a similar label by means of an attachment with a predetermined break line consisting of a series of perforations.

6. In combination, a container and a label for the container, the container comprising: upper and lower portions connected by a rib, the upper portion being movable between an open and a closed position relative to the lower portion, the upper portion having a top, and inward projection extending from the top, and sidewalls; and fastening means for fastening the upper and lower portions in the closed position, the label comprising: a central portion having edges and applied to the top of the upper portion, and at least one extension portion adjacent one of the edges of the central portion, the extension portion overlying at least a part of a sidewall of the upper portion, the central portion having means for accommodating the inward projection on the top of the upper portion so that the inward projection can pass therethrough to enable a plurality of the combination container and label to be stacked one above the other when the container is in the open position.

7. The combination of claim 6 wherein the inward projection is hollow and a frusto-conical shape.

8. The combination of claim 6 wherein the fastening means comprises a pair of pressure fastenings located on the upper and lower portions respectively.

9. The combination of claim 6 wherein the central portion is rectangular in shape, and an extension portion is located adjacent each edge of the central portion so as to overly the sidewalls of the upper portion.

10. The combination as claimed in claim 9 wherein the extension portions are rectangular in shape.

11. The combination of claim 6 wherein the central portion has rounded corners.

12. The combination of claim 6 wherein the means for accommodating the inward projection comprises a plurality of tabs produced by cuts in the label, the cuts intersecting each other at a point which lies on a longitudinal axis of an inward projection.

13. The combination of claim 6 wherein the means for accommodating the inward projection comprises a plurality of tabs produced by cuts in the label, the cuts intersecting each other at a point lying on a longitudinal axis of an inward projection, the ends of the tabs being cut to form a circular hole which is coaxial with the point of intersection of the cuts.

14. The combination of claim 6 wherein the means for accommodating the inward projection comprises a hole in the label, the center of the hole lying on a longitudinal axis of the inward projection, the hole being circular and of a diameter which is equal to or slightly greater than the width of the inward projection at its widest point.

15. The combination of claim 6 wherein the label is attached to a similar label by means of an attachment, with a predetermined breakline at the attachment.

16. The combination of claim 15 wherein the breakline consists of a series of perforations.

* * * * *